US006154141A

United States Patent [19]

Prater et al.

[11] Patent Number: 6,154,141

[45] Date of Patent: Nov. 28, 2000

[54] SLEEP ALERTING APPARATUS FOR A VEHICLE OPERATOR

[76] Inventors: Charles B. Prater, P.O. Box 531, Plainville, Ga. 30733; E. Clifford Vaught, P.O. Box 2470, Calhoun, Ga. 30703-2470

[21] Appl. No.: 09/431,250

[22] Filed: Nov. 1, 1999

[51] Int. Cl.[7] ..... G08B 23/00

[52] U.S. Cl. ..... 340/575; 340/576; 340/573.6; 340/689; 340/571; 340/439

[58] Field of Search ..... 340/575, 576, 340/573.7, 689, 573.6; 2/209.13, 209.14, 195.1, 200.1, 171

[56] References Cited

U.S. PATENT DOCUMENTS 3,999,177 12/1976 Greene ..... 340/279
4,272,764 6/1981 Herr et al. ..... 340/575
5,522,092 6/1996 Streb et al. ..... 340/575
5,684,461 11/1997 Jones ..... 340/575
5,845,987 12/1998 Painter ..... 362/206
5,923,263 7/1999 Rodriguez ..... 340/689.1

*Primary Examiner*—Jeffery A. Hofsass
*Assistant Examiner*—Hung Nguyen
*Attorney, Agent, or Firm*—Norman B. Rainer

[57] ABSTRACT

A sleep alert apparatus adapted to be worn upon the head of the operator of a transportation vehicle includes a baseball-type cap, a flexible pouch attached to the exterior surface of a side portion of the cap, and having an upwardly directed entrance opening, and a tilt monitoring device removably insertable into the pouch. The tilt monitoring device includes a housing confining a gravity activated switch, a noise generator, and a battery power source.

5 Claims, 2 Drawing Sheets

SLEEP ALERTING APPARATUS FOR A VEHICLE OPERATOR

BACKGROUND OF THE INVENTION

1. Field of the Invention

The invention pertains to systems for detecting impairment of the operating ability of transportation vehicle operators, especially motor vehicle operators, and for alerting the operator when a state of impairment is detected.

2. Description of the Prior Art

It is well known that a great many serious injuries and fatalities are caused each year by motor vehicle accidents resulting from impairment of driving ability of the vehicle operator, which may arise from a number of different causes. Many such accidents are caused when operators have driven too long without sleep, and begin to fall asleep at the wheel, often without realizing their state of impairment. Even if the operator does not actually fall completely asleep, the operator in the sleepy state will have substantially impaired alertness and reflexes, and may be unable to respond in time to some hazard encountered in traffic.

Or an operator may have consumed alcoholic beverage, and may have reached a greater state of intoxication, then he or she realizes. Such partial intoxication, besides substantially dulling the reflexes, can also make the operator sleepy and generally less alert to the requirements of proper driving in traffic.

There are a variety of other physical conditions which may cause an operator to become too sleepy to safely operate the vehicle. Narcolepsy, for example may cause an operator to suddenly fall asleep, without warning. Sometimes an operator may suddenly become too sleepy, or insufficiently alert, as a result of the effects of aging.

In many instances an early sign of imminent serious operator impairment, is a change in inclination of the head, which will be different in nature from normal head inclinations that occur during driving. Fakhar et. al., "Effect of Sound and Vibration on Vigilance", Laboratoire Energie Nuisances (LEN) (France), INRETS No. 153, 1992, at 90–92.

Research has confirmed this correlation between change in head inclination and reduced attentiveness. This is attributed to physiological changes in muscle tone, resulting in a progressive change in head and neck alignment, culminating in "nodding off".

Numerous devices have heretofore been disclosed for producing an audible awakening alarm responsive to a predetermined tilt angle of the operator's head. Devices of such nature adapted to be worn on the operator's ear are described for example in U.S. Pat. Nos. 3,045,225; 4,354,179; and D294,562. Despite the several design modifications shown in said patents, the ear-mounted devices, unless custom fitted to the particular operator, are uncomfortable to wear, and are likely to fall off the operator's ear. Such devices also cannot be used with the concomitant wearing of eyeglasses.

Eyeglass-mounted tilt angle alerting devices are disclosed in U.S. Pat. Nos. 4,875,030 and 4,272,764. When built into the earpiece of the eyeglass frame, as in U.S. Pat. No. 4,875,030, the expense of the overall eyeglass plus alerting device is considerable. When clamped onto the earpiece of the eyeglass, as in U.S. Pat. No. 4,272,764, there is considerable discomfort to the wearer.

Tilt angle alerting devices have been described in association with hats or caps that would be worn by the vehicle operator. For example, U.S. Pat. No. 4,272,764 discloses an alerting device that is clamped onto the side of a baseball-type cap. Although potentially effective in such manner of use, the clamp component is pressed against the wearer's head, thereby producing discomfort with long-term use. U.S. Pat. Nos. 5,923,263 and 5,522,092 involve devices of complex construction and interactive with a hat in a specialized manner to make the hat unattractive and restricted to use only for the specialized purpose of providing an overall sleep-alerting apparatus.

It is accordingly an object of the present invention to provide a sleep alert apparatus involving a baseball-type cap and a tilt-monitoring device removably associated with the exterior of said cap.

It is another object of this invention to provide a sleep alert apparatus as in the foregoing object which is comfortable to use and does not depreciate the appearance of the cap.

It is a further object of the present invention to provide a sleep alert apparatus of the aforesaid nature which is of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a sleep alert apparatus adapted to be worn upon the head of the operator of a transportation vehicle, said apparatus comprising:

a) a cap fabricated of compliant cloth and shaped in the form of a baseball cap, said cap having a top panel portion and downwardly extending front, rear and opposed side panel portions, thereby defining a hollow interior opening and an opposed exterior surface, said opening being adapted to receive therein an operator's head, b) a flexible pouch having an upwardly directed entrance opening, said pouch attached to the exterior surface of a sidewall panel portion, and c) a tilt monitoring device removably insertable into said pouch, said device comprising gravity activated switch means, a noise generator, and a battery power source responsive to said switch for energizing said noise generator.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
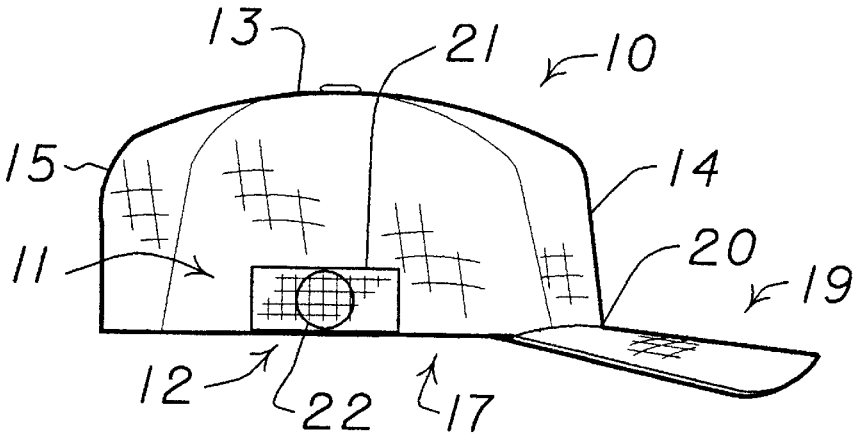
FIG. 1 is a side view of an embodiment of the sleep alert apparatus of the present invention.
Figure 2:
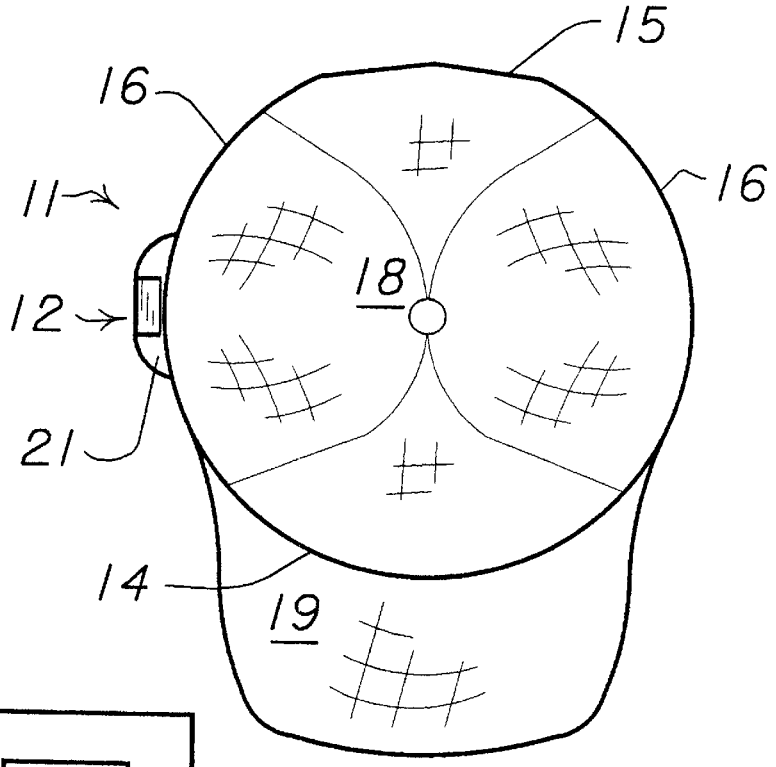
FIG. 2 is a top view of the apparatus of FIG. 1.
Figure 3:
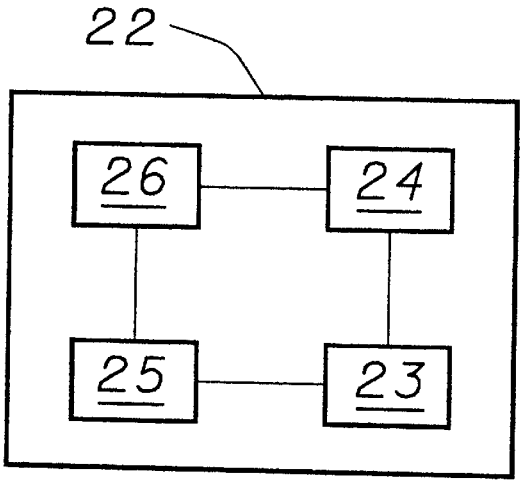
FIG. 3 is a schematic diagram showing the components of an embodiment of a tilt monitoring device useful in the sleep alert apparatus of this invention.

Referring now to FIGS. 1–3, an embodiment of the sleep alert apparatus of the present invention is shown comprised of cap 10 having a flexible pouch 11 which removably contains a tilt monitoring device 12.

Cap 10 is fabricated of a compliant cloth material, and is shaped in the form of a baseball cap. The cap has a top panel portion 13 and, downwardly extending therefrom, front, rear and opposed side panel portions, 14, 15 and 16, respectively. Said several panel portions may be integral portions of a single piece of fabric, or may be interconnected, as by sewing. Said panel portions in concert define a hollow interior opening 17 and an opposed exterior surface 18. Said opening is adapted to seat onto an operator's head. A substantially rigid brim 19 extends forwardly and horizontally from the lower extremity 20 of front panel portion 14.

Pouch 11 is attached, as by sewing to the exterior surface of a sidewall panel portion. Said pouch preferably has elastomeric properties, conferring the ability to expand to receive articles, and then to contact and thereby secure said received article in a manner which prevents uncontrolled movement of said article. An opening 21 is disposed at the upper extremity of said pouch. The pouch may be of generally rectangular contour, as shown in FIG. 1, and may in fact be comprised of a single layer of elastomeric fabric sewn to the sidewall panel portion, whereby said panel portion constitutes the interior wall of the pouch. The elastomeric character of the pouch may be achieved by use of fabric comprised of elastomeric fibers such as Lycra, a product of the E. I. duPont Company of Wilmington, Del.

The tilt monitoring device 12 is of a size permitting removable insertion into pouch 11. Device 12 is comprised of housing 22 which confines a gravity activated switch means 23 which may be a conventional mercury switch or a conventional switch employing a rolling ball. A noise generator 24, which may be a bell, buzzer or equivalent mechanism is interactive with said switch means within said housing. Radio transmitter means 30 capable of turning the volume of the vehicle's radio up or down may also be incorporated into said tilt monitoring device. Since the operator often plays the radio loud to help stay awake, the effect of the bell or buzzer is enhanced if the radio's volume is automatically lowered at the same time the buzzer sounds. A battery power source 25, which may be comprised of one or more dry cell batteries is located preferably within housing 22. Said switch means, noise generator, and power source are electrically interconnected in a manner whereby a downward movement of the cap causes the power source to actuate the noise generator, thereby alerting the operator of his drowsy condition. An on/off control means such as button 26 is preferably included for deactivating the apparatus when not in use.

Because the tilt monitoring device is located on the exterior surface of the cap, it does not produce discomfort, even with long term use. The fact that the device can be variably positioned within the pouch, and the cap can be variably positioned upon the operator's head provides for easy adjustment of the desired tilt angle which activates the noise generator. The fact that the tilt monitoring device can be removed from the pouch permits the cap to be useful for other, ordinary uses.

Figure 4:
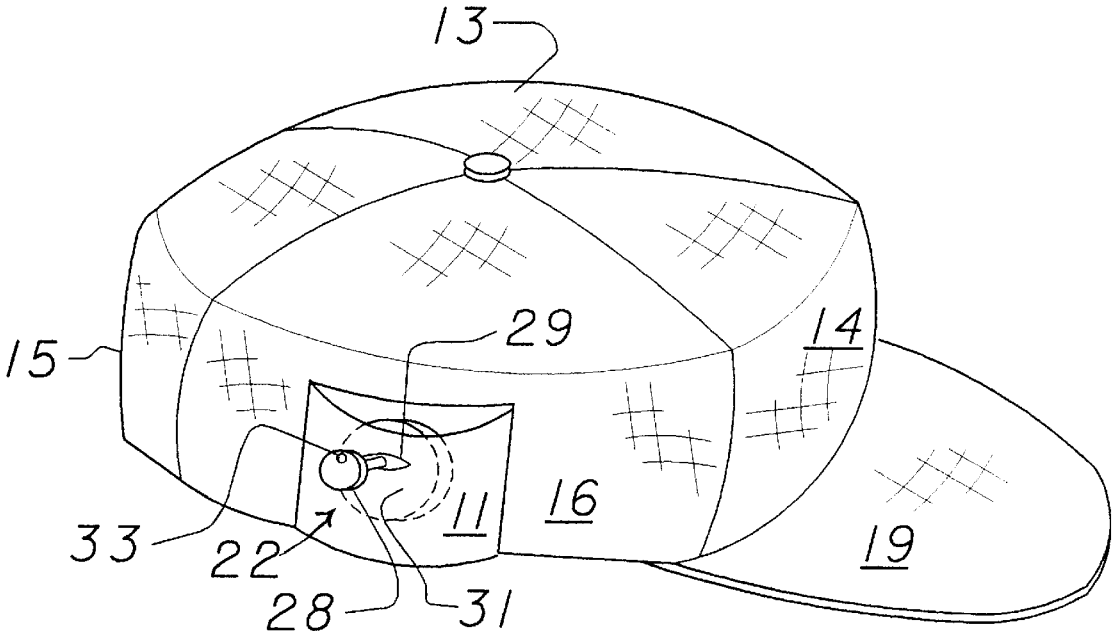
FIG. 4 is a perspective view of an alternative embodiment of the apparatus of this invention.

In the preferred embodiment shown in FIG. 4, housing 22 is of circular contour having substantially flat sidewalls 31. A control button 28 attached to sidewall 31 protrudes through a button-hole aperture 29 in pouch 11. The function of control button 28 is to facilitate rotative manipulation of the device 12 so as to achieve a desired activation angle, and also to serve as on/off control means 26 by virtue of an in/out axial movement of the button. Tactile sensing means in the form of upraised protuberance 33 enables the user to ascertain the rotative position of button 28 without having to look at it.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A sleep alert apparatus adapted to be worn upon the head of the operator of a transportation vehicle, said apparatus comprising:

a) a cap fabricated of compliant cloth and shaped in the form of a baseball cap having a forwardly extending rigid brim, a top panel portion and downwardly extending front, rear and opposed side panel portions, thereby defining a hollow interior opening and an opposed exterior surface, said opening being adapted to receive therein an operator's head, b) a flexible pouch having an upwardly directed entrance opening, said pouch comprised of a layer of elastomeric fabric sewn to the exterior surface of a sidewall panel portion, thereby permitting expansion and contraction of said pouch, and c) a tilt monitoring device removably insertable into said pouch, said device comprising a housing of circular contour having substantially flat sidewalls, said housing confining a gravity activated mercury switch, a noise generator, and a battery power source responsive to said switch for energizing said noise generator, whereby d) when said monitoring device is inserted into said pouch, contraction of said pouch prevents uncontrolled movement of the device.

2. A sleep alert apparatus adapted to be worn upon the head of the operator of a transportation vehicle, said apparatus comprising:

a) a cap fabricated of compliant cloth and shaped in the form of a baseball cap having a forwardly extending rigid brim, a top panel portion and downwardly extending front, rear and opposed side panel portions, thereby defining a hollow interior opening and an opposed exterior surface, said opening being adapted to receive therein an operator's head, b) a flexible pouch having an upwardly directed entrance opening, said pouch comprised of a layer of elastomeric fabric sewn to the exterior surface of a sidewall panel portion, thereby permitting expansion and contraction of said pouch, and c) a tilt monitoring device removably insertable into said pouch, said device comprising a housing of circular contour having substantially flat sidewalls, said housing confining a gravity activated mercury switch, a noise generator, and a battery power source responsive to said switch for energizing said noise generator, and a control button attached to a sidewall and adapted to protrude through an aperture in said layer of elastomeric fabric, whereby d) when said monitoring device is inserted into said pouch, contraction of said pouch prevents uncontrolled movement of the device.

3. The apparatus of claim 2 wherein said tilt monitoring device is further provided with transmitter means capable of controlling the volume of a radio.

4. The apparatus of claim 2 wherein said control button permits manual rotation of said housing.

5. The apparatus of claim 4 wherein said control button also serves as an on/off switch for said tilt monitoring device.

* * * * *